US011535801B2

(12) United States Patent
Carson

(10) Patent No.: US 11,535,801 B2
(45) Date of Patent: Dec. 27, 2022

(54) REMOVABLE BEND CAP IN TUBING FOR INDUSTRIAL PROCESS EQUIPMENT

(71) Applicant: 1863815 Ontario Limited, Point Edward (CA)

(72) Inventor: Glenn L. Carson, Point Edward (CA)

(73) Assignee: 1863815 Ontario Limited, Point Edward (CA)

( * ) Notice: Subject to any disclaimer, the term of this patent is extended or adjusted under 35 U.S.C. 154(b) by 314 days.

(21) Appl. No.: 16/767,493

(22) PCT Filed: Nov. 27, 2018

(86) PCT No.: PCT/CA2018/051507

§ 371 (c)(1),
(2) Date: May 27, 2020

(87) PCT Pub. No.: WO2019/100171

PCT Pub. Date: May 31, 2019

(65) Prior Publication Data

US 2020/0377800 A1 Dec. 3, 2020

Related U.S. Application Data

(60) Provisional application No. 62/590,832, filed on Nov. 27, 2017, provisional application No. 62/746,222, filed on Oct. 16, 2018.

(51) Int. Cl.
*C10G 9/20* (2006.01)
*F27D 11/12* (2006.01)
(Continued)

(52) U.S. Cl.
CPC ..... *C10G 9/20* (2013.01); *F27D 11/12* (2013.01); *F28F 9/26* (2013.01); *F28G 7/00* (2013.01);
(Continued)

(58) Field of Classification Search
CPC ..... C10G 9/20; C10G 2300/1044; C10G 2300/1081; F27D 11/12; F28D 1/0475;
(Continued)

(56) References Cited

U.S. PATENT DOCUMENTS 3,930,536 A 1/1976 Cherry et al.

FOREIGN PATENT DOCUMENTS

CN 1268480 A 10/2000

OTHER PUBLICATIONS

International Search Report Issued in corresponding PCT Application No. PCT/CA2018/051507; search completed Jan. 22, 2019.

*Primary Examiner* — Brian A McCaig
(74) *Attorney, Agent, or Firm* — CPST Intellectual Property Inc.; Santosh K. Chari

(57) ABSTRACT

An apparatus for heating a fluid is provided, the apparatus comprising a chamber and one or more tubes for conveying the fluid through the chamber, wherein at least one of the tubes has a bend and the bend comprises a removable bend cap including at least one microwave emitter. In another aspect, there is provided an apparatus for removably attaching a bend in tubing for conveying a fluid through the enclosure, the bend having a removable bend cap, and the apparatus comprising a sleeve extending through an opening in the enclosure, wherein the sleeve is adapted to receive the removable bend cap. In yet another aspect, there is provided an apparatus having an enclosure and tubing within the enclosure, the tubing being to convey fluid through the enclosure. At least one of the tubes has a bend, and the bend comprises a removable bend cap which comprises a cleaning device.

19 Claims, 12 Drawing Sheets

(51) Int. Cl.

| | |
|---|---|
| ***F28F 9/26*** | (2006.01) |
| ***F28G 7/00*** | (2006.01) |
| ***H05B 6/80*** | (2006.01) |

(52) U.S. Cl.
CPC ..... *H05B 6/80* (2013.01); *C10G 2300/1044* (2013.01); *C10G 2300/1081* (2013.01); *F28F 2220/00* (2013.01); *F28F 2280/02* (2013.01)

(58) Field of Classification Search
CPC . F28D 7/12; F28F 9/26; F28F 2220/00; F28F 2280/02; F28G 7/00; H05B 6/80
See application file for complete search history.

REMOVABLE BEND CAP IN TUBING FOR INDUSTRIAL PROCESS EQUIPMENT

CROSS-REFERENCE TO RELATED APPLICATIONS

This application is a National Entry of PCT Application No. PCT/CA2018/051507, filed on Nov. 27, 2018, which claims priority to U.S. Provisional Patent Application No. 62/590,832, filed on Nov. 27, 2017, and U.S. Provisional Patent Application No. 62/746,222, filed on Oct. 16, 2018. The entire contents of the aforementioned applications are incorporated herein by reference as if set forth in their entirety.

TECHNICAL FIELD

The following generally relates to a removable bend in tubing for industrial process equipment.

BACKGROUND

Heat exchangers and chemical reactors are often used in industrial processes. Tubing is often used in industrial process equipment including, for example, heat exchangers and cracking furnaces. In cracking furnaces and heat exchangers, there are parallel tubes connected to each other at their ends using bends, such as U-bends or other types of bends, to form a continuous tube. Fluid (e.g. liquids, gases, vapors, or combinations thereof) typically flows through the piping while the chamber or environment around the piping is heated to heat the fluid flowing within the piping.

In an example application of furnaces, steam-cracking is used to manufacture ethylene, propylene, butadiene and other materials. In a tubular reactor for cracking, a furnace houses banks of tubes that are connected to each other to form one or more continuous tubes for fluid to flow through. The tubes may form a serpentine configuration.

The straight parallel portions of the tubing are typically positioned close together to reduce the amount of space being used within the furnace or the heat exchanger. There may be dozens to hundreds of straight portions of tubes. The inner diameter of the tubes typically range from under one inch to several inches. However, other diameters of tubing can be used.

The cracking process results in deposits, scales, product or by-product build-up, and material in general to collect on the inner surfaces of the tubes. For example, the built-up material could include coke. This reduces the flow of fluid within the tubes, as well as the efficiency of the cracking process.

Cleaning the tubes in the furnace is costly, typically requires a lot of manual labour and large machinery, and typically requires an extended amount of time during which the cracking furnace is shut down.

Cleaning the bend portions of tubes (e.g. U bends or other shaped bends) is difficult because of deposits and scales tend to build up more in these portions. Furthermore, due to the shape, it is more difficult to access these bend portions.

For example, to inspect or clean the tubing, the furnace is shut down and allowed to cool for several days. After being cooled, it is then safe for a person (e.g. a technician) to then inspect and/or service the tubing. In particular, a person enters through a door into the interior of the furnace in order to access the tubing. Typically, the person can only inspect the exterior surfaces of the tubing, or will need to use special equipment (e.g. a camera on a wire) to inspect the interior of the tubing.

To access the inner surfaces of the tubing or the space within the tubing, a person may weld or cut off a section of tubing. After inspection or cleaning, or both, the person then welds back the cut-off section of tubing. In another approach, a person brings an X-ray device into the furnace to inspect the inside of the tubing.

In some cases, scaffolding is brought into and setup within the furnace so that personnel can inspect the upper portions of tubing, including the bends located at the top. The scaffolding is also dismantled and after inspection and/or servicing, and is removed from the furnace before it is operable again. It will be appreciated that scaffolding is used since the tubing can, in some cases, extend several stories high (e.g. 20 ft, 50 ft, 100 ft, etc.).

One known approach to clean tubes in a cracking furnace includes shutting down the furnace and then flushing a cleaning fluid through the tubing.

In another approach, the furnace is shut down, and one or more pigs are flushed through the tubes under high pressure to scrape the inner surfaces of the tubes.

In another approach, entire sections of the tubing structure are removed from the furnace and are transported to a cleaning facility. At the cleaning facility, the entire section of the tubing is immersed in a large ultrasonic bath. The treated tube sections are then transported back to the cracking furnace to be re-installed. It is recognized, however, that the removal, transportation, and re-installation of the tube sections requires manual effort and increases the amount of time that the cracking furnace is inoperable.

It is recognized that these inspection or cleaning approaches, or both, incur a significant amount of effort and time during which the furnace is inoperable.

Furthermore, steam cracking plants are some of the most energy intensive plants in the chemical industry. The steam cracking process is conducted using high temperatures to facilitate a thermal cracking reaction in the tubular reactor to produce ethylene and other materials. Furnace guns or heat generators, for example, surround the banks of tubes to raise the temperature of the reactants.

It is recognized that furnace guns or heat generators used in steam cracking or other industrial processes are often powered by fossil fuels; the consumption of which can incur significant costs, and can increase a process' carbon footprint.

It is therefore herein recognized that it is desirable to address one or more of these drawbacks.

SUMMARY OF THE DESCRIPTION

In an aspect, provided herein is an apparatus for heating a fluid, the apparatus comprising: a chamber; one or more tubes for conveying the fluid through the chamber, at least one of the tubes having a bend; and the bend comprising a removable bend cap, the removable bend cap including at least one microwave emitter.

In another aspect, provided herein is an apparatus for removably attaching a bend in one or more tubes in an enclosure, the one or more tubes being for conveying a fluid through the enclosure, the apparatus comprising: the bend, the bend comprising a removable bend cap; and a sleeve comprising a first end extending into the enclosure through an opening in a wall of the enclosure, the sleeve further comprising a second end extending through the opening to an exterior of the enclosure, the second end of the sleeve comprising a first flange and a jacking bracket, the jacking bracket comprising a second flange, the second flange being removably attached to the first flange.

In yet another aspect, provided herein is an apparatus having one or more tubes within an enclosure, the apparatus comprising: the one or more tubes being for conveying a fluid through the enclosure, at least one of the tubes having a bend; and the bend comprising a removable bend cap, the removable bend cap including at least one cleaning device.

In yet another aspect, an apparatus is provided for accessing a bend of a tube within an enclosure. The apparatus includes a tube comprising two sections connected with a bend portion, the two sections of the tube being fixed in place, and the bend portion including a removable bend cap that is connected to the two sections. The removable bend cap includes an exterior bracing surface, an interior surface that defines part of the bend in the tube, and a seating surface that sits against an end surface of the two sections of the tube. The apparatus also includes a jacket connected to the two sections of the tube and extending through a passage defined in a wall of an enclosure to an exterior of the enclosure, the tube located within the enclosure, wherein an interior wall of the jacket is dimensioned for the removable bend cap to slide in and out of the jacket. The apparatus further includes a push mechanism positioned within the jacket that exerts a pushing force against the exterior bracing surface of the removable bend cap to push the seating surface against the end surface of the two sections of the tube.

In yet another aspect, the apparatus further includes a jacking bracket that is removably connected to the jacket, and the push mechanism is connected to the jacking bracket.

In another aspect of the apparatus, the jacking bracket holds jack screws that can be turned to control the amount of the pushing force exerted against the exterior bracing surface of the removable bend cap.

In yet another aspect of the apparatus, the interior surface that defines part of the bend in the tube is a rounded concave surface.

In yet another aspect of the apparatus, the bend portion includes an inner radius bend surface and an outer radius bend surface, and the rounded interior surface of the removable bend portion forms the outer radius bend surface, and the inner radius bend surface is part of the fixed portion of the tubing.

In yet another aspect of the apparatus, the jacking bracket includes a flange, the exterior portion of the jacket comprises a flange, and the apparatus further comprises a blind flange connected over the flange of the jacking bracket, and wherein the blind flange, the flange of the jacking bracket and the flange of the jacket are mechanically fastened together.

In yet another aspect of the apparatus, a space is defined between the blind flange and the jacking bracket, and an insulator is positioned within the space.

In yet another aspect of the apparatus, a space is defined between an interior surface of the jacking bracket, the interior wall of the jacket, and the bracing surface of the removable bend cap, and an insulator is positioned within the space.

In yet another aspect of the apparatus, the apparatus further includes an electrical cleaning device embedded in the removable bend cap for cleaning interior surfaces of the tube.

In yet another aspect of the apparatus, the apparatus further includes a micro-wave emitter embedded in the removable bend cap to heat the fluid flowing through the tubing. The micro-wave emitter can be used with or replace the electrical device.

In yet another aspect of the apparatus, the jacket is welded to the two sections of the tube.

In another aspect, a furnace is provided and it includes: one or more furnace walls defining an interior space; at least one tube located within the interior space, the at least one tube comprising two sections connected with a bend portion, the two sections of the tube being fixed in place, and the bend portion including a removable bend cap that is connected to the two sections; the removable bend cap comprising an exterior bracing surface, an interior surface that defines part of the bend in the tube, and a seating surface that sits against an end surface of the two sections of the tube; a jacket connected to the two sections of the tube and extending through a passage defined in a given furnace wall to an exterior of the furnace, wherein an interior wall of the jacket is dimensioned for the removable bend cap to slide in and out of the jacket; and a push mechanism positioned within the jacket that exerts a pushing force against the exterior bracing surface of the removable bend cap to push the seating surface against the end surface of the two sections of the tube.

In yet another aspect, the furnace further includes a jacking bracket that is removably connected to the jacket, and the push mechanism is connected to the jacking bracket.

In another aspect of the furnace, the jacking bracket holds jack screws that can be turned to control the amount of the pushing force exerted against the exterior bracing surface of the removable bend cap.

In yet another aspect of the furnace, the bend portion include an inner radius bend surface and an outer radius bend surface, and the rounded interior surface of the removable bend portion forms the outer radius bend surface, and the inner radius bend surface is part of the fixed portion of the tubing.

In yet another aspect of the furnace, the jacking bracket includes a flange, the exterior portion of the jacket includes a flange, and the apparatus further includes a blind flange connected over the flange of the jacking bracket, and wherein the blind flange, the flange of the jacking bracket and the flange of the jacket are mechanically fastened together.

In yet another aspect of the furnace, a space is defined between the blind flange and the jacking bracket, and an insulator is positioned within the space.

In yet another aspect of the furnace, a micro-wave emitter is embedded in the removable bend cap.

In another aspect, a kit of parts for an apparatus is provided to access a bend in a tube. The kit of parts includes: a removable bend cap comprising an exterior bracing surface, a rounded interior surface that defines part of a bend in a tube, and a seating surface, wherein, in assembly, the seating surface sits against an end surface of the tube, and the end surface of the tube defines an opening leading two sections of the tube that are connected by the bend; a jacket that can be attached at one of its ends to the two sections of the tube and wherein an interior wall of the jacket is dimensioned for the removable bend cap to slide in and out of the jacket; and a push mechanism, that when assembled, is positioned within the jacket and exerts a pushing force against the exterior bracing surface of the removable bend cap to push the seating surface against the end surface of the two sections of the tube.

In another aspect of the kit of parts, the bend of the tube includes an inner radius bend surface and an outer radius bend surface, and the rounded interior surface of the removable bend forms the outer radius bend surface.

In yet another aspect, the kit of parts further includes a jacking bracket that is removably connected to the jacket, and the push mechanism is connected to the jacking bracket.

In yet another aspect, the kit of parts further includes a micro-wave emitter embedded in the removable bend cap to heat the fluid flowing through the tubing.

In yet another aspect of the kit of parts, the jacking bracket holds jack screws that can be turned to control the amount of the pushing force exerted against the exterior bracing surface of the removable bend cap.

In yet another aspect of the kit of parts, the jacking bracket includes a flange, the opposite end of the jacket comprises a flange, and the kit of parts further comprises a blind flange that is connectable over the flange of the jacking bracket, and wherein the blind flange, the flange of the jacking bracket and the flange of the jacket can be mechanically fastened together.

In yet another aspect, a method is provided for retrofitting a furnace that includes tubing positioned with one or more furnace walls. The method includes: cutting off a portion of tubing at a bend that connects two sections of tubing, wherein a cut-off portion of the tubing includes at least an outer radius bend surface of the bend; cutting a hole in a furnace wall to define a passage therein; attaching a jacket to the two sections of the tubing, wherein the jacket extends from within the furnace, through the passage defined in the furnace wall, and to an exterior of the furnace; positioning a removable bend cap within the jacket, the removable bend cap comprising an exterior bracing surface, a rounded interior surface that defines part of a bend in a tube, and a seating surface, and wherein the seating surface sits against an end surface of the tube, and the end surface of the tube defines an opening leading two sections of the two sections of the tubing; fastening a jacket bracket to an exterior portion of the jacket that is located exterior to the furnace; and engaging a push mechanism that is attached to the jacking bracket to exerts a pushing force against the exterior bracing surface of the removable bend cap to push the seating surface against the end surface of the two sections of the tubing.

In yet another aspect, the method further includes embedding a micro-wave emitter in the removable bend cap.

In yet another aspect, the method further includes fastening a blind flange to the jacket bracket, wherein the blind flange, a flange of the jacking bracket and a flange of the jacket are mechanically fastened together.

In yet another aspect, a method is provided for manufacturing a furnace that includes tubing positioned with one or more furnace walls. The method includes: attaching a jacket to the two sections of the tubing, wherein the jacket extends from within the furnace, through a passage defined in the furnace wall, and to an exterior of the furnace; positioning a removable bend cap within the jacket, the removable bend cap comprising an exterior bracing surface, a rounded interior surface that defines part of a bend in a tube, and a seating surface, and wherein the seating surface sits against an end surface of the tube, and the end surface of the tube defines an opening leading two sections of the two sections of the tubing; fastening a jacket bracket to an exterior portion of the jacket that is located exterior to the furnace; and engaging a push mechanism that is attached to the jacking bracket to exerts a pushing force against the exterior bracing surface of the removable bend cap to push the seating surface against the end surface of the two sections of the tubing.

In yet another aspect, this method further includes embedding a micro-wave emitter in the removable bend cap.

In yet another aspect, there is provided a method for heating a fluid flowing through tubing in industrial process equipment, the method comprising heating the fluid using at least one micro-wave emitter embedded in any configuration in the tubing.

In yet another aspect, this method further includes heating the fluid flowing through the tubing in the industrial process equipment, wherein the at least one microwave emitter is provided in an accessible bend of the tubing.

BRIEF DESCRIPTION OF THE DRAWINGS

The present description is illustrated by way of example only with reference to the appended drawings wherein.

DETAILED DESCRIPTION OF THE DRAWINGS

Figure 1:
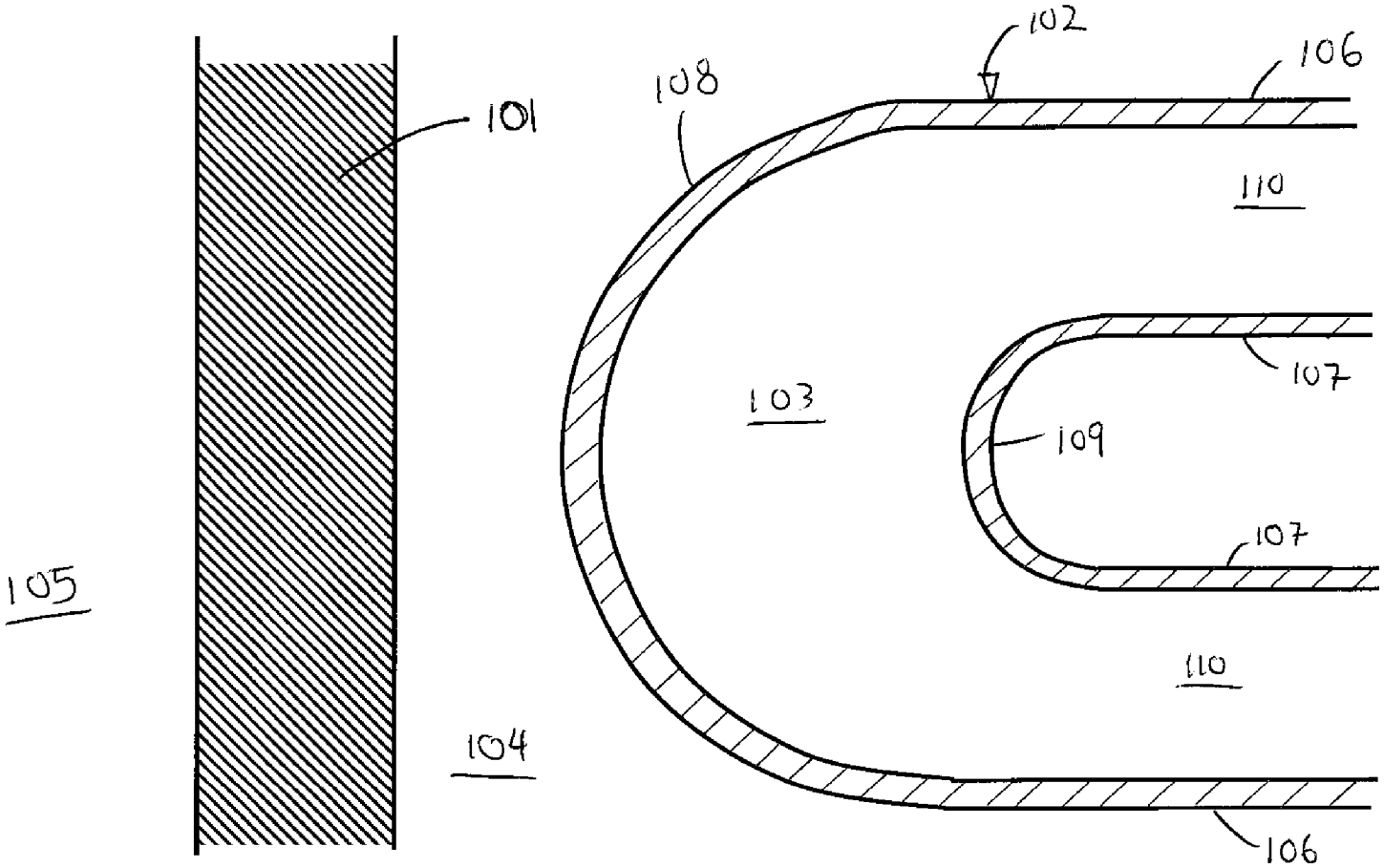
FIG. 1 (Prior Art)
FIG. 1 is a cross-sectional view of a bend portion of a tube within an enclosure, and further showing a cross-section of a wall of the enclosure.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures and components have not been described in detail so as not to obscure the example embodiments described herein. Also, the description is not to be considered as limiting the scope of the example embodiments described herein.

It is herein recognized that cleaning the inner surface of tubing in cracking furnaces and heat exchangers is difficult due to various factors, including limited access, the long length of tubing, and the multiple U-bends connecting straight segments of the tubing.

It is also herein recognized that operation of furnace guns, heat generators and other heating unit operations used in industrial processes involves the consumption of significant amounts of fossil fuels, which increases the carbon footprint associated with such operation.

Within the enclosure of the furnace are a number of tubes. In many furnaces, the tubes are vertically oriented. However, the tubes may be oriented in other orientations (e.g. diagonally, horizontally, etc.).

The furnace, for example, is a hydrocracking furnace, a steam cracking furnace, a gas cracking furnace, or a liquid cracking furnace. In steam cracking, for example, gaseous or liquid hydrocarbon feed streams such as naptha, liquefied petroleum gas and ethane are broken down (cracked) into desirable products including ethylene propylene and butadiene. Other types of currently known or future known cracking furnaces are applicable. It is appreciated that, while many of the examples described herein relate to furnaces, the features described herein are also applicable to other structures that have tubing.

More generally, any equipment having tubing with at least one bend, wherein the tubing is for conveying a fluid through an enclosure, can benefit from the systems and methods provided herein.

Turning to FIG. 1, an example of a portion of a furnace wall 101 is shown, which separates an interior space 104 from the exterior space 105. Within the interior space 104 of the furnace, there is tubing. In FIG. 1, a cross-sectional view of the tubing 102 with a U bend is shown. Fluid passes through a straight passage 110 defined within the tubing, then through a bend passage 103 defined within the tubing, and then to another straight passage 110 defined within the tubing. In particular, the bend includes an outer straight portion 106 and an inner straight portion 107 that respectively lead to an outer bend portion 108 and an inner bend portion 109. The outer bend portion 108 and the inner bend portion 109 then respectively lead to another outer straight portion 106 and another inner straight portion 107.

As can be seen in FIG. 1, the bend portion of the tubing is not accessible.

It will be appreciated that although an example orientation of the U bend is shown relative to the furnace wall 101, other orientations are applicable.

Figure 2:
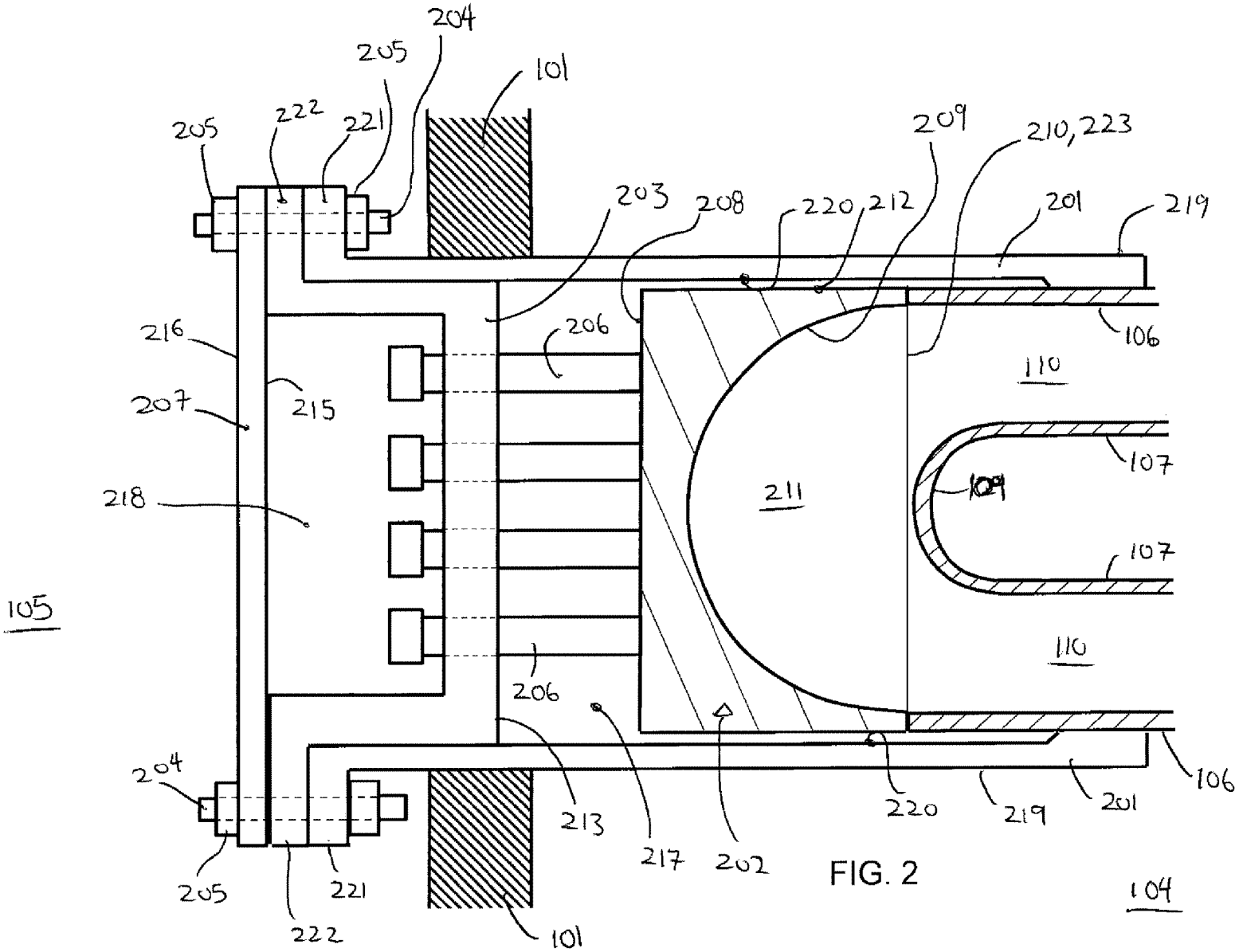
FIG. 2 is a cross-sectional view of a removable bend portion of a tube with a securing apparatus, according to an example embodiment.
Figure 6A:
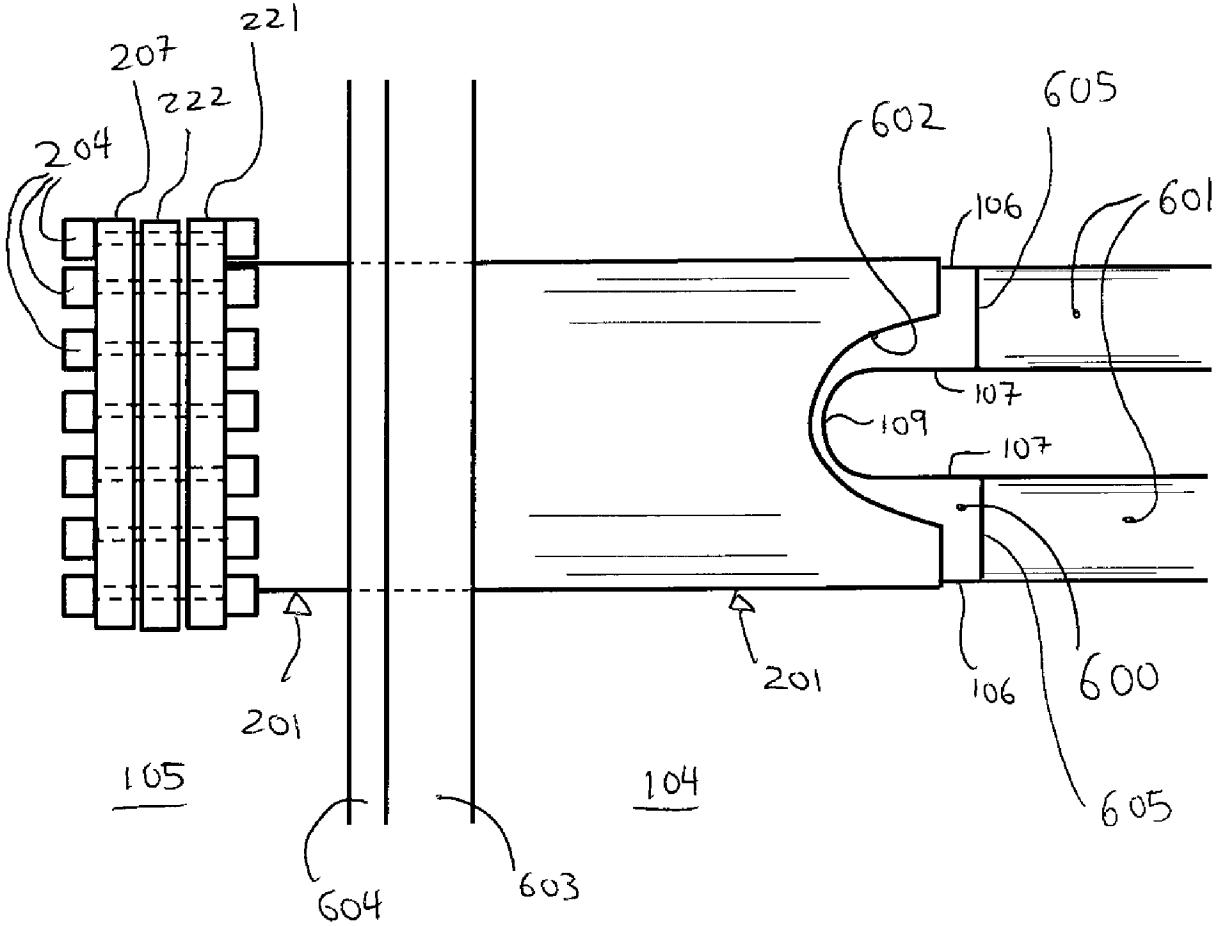
FIG. 6A is a side view of the fixed portion of the tubing with the securing apparatus extending from within the enclosure to the exterior of the enclosure, and passing through a passage defined within the enclosure wall shown in cross-section, according to an example embodiment.

Turning to FIG. 2, an example embodiment of a removable bend portion, also called a bend cap, 202 is shown braced against tubing portions 106, 107, 109. These portions and the section of the furnace wall 101 are shown in a cross-sectional view. A jacket 201, also called a sleeve, is fixed to the two straight portions of the tubing, such as, but not limited to portion 106. The jacket 201 extends from within the interior space 104 of the furnace, passes through the furnace wall 101, and extends outwards into the exterior space 105. The inner surface of the jacket 220 is dimensioned to allow the removable bend cap 202 to slide in and out of the jacket. In other words, there is some space between the inner surface 220 of the jacket and the exterior side surface 212 of the bend cap 202. It is appreciated that the furnace wall is sealed to the outer surface 219 of the jacket 201, so that heat and other gases, fluids, liquids, vapors, etc. do not escape, from the interior of the furnace to the exterior space 105, or that such escape is reduced to an appropriate level. There is also a seal between the jacket 220 and the fixed section or sections of tubing, so that liquids, gases, vapors, plasma, or combinations thereof, do not escape. In an example embodiment, the seal between the jacket 220 and the tubing is a seal weld, but other types of seals can be used. Another view of the jacket and the tubing is shown in FIG. 6A.

A push mechanism is positioned within the jacket 201 that exerts a pushing force against the exterior bracing surface 208 of the removable bend cap 202 to push a seating surface 210 of the removable bend cap against an end surface 223 of the two sections of the tubing. The example push mechanism in FIG. 2 is shown as jack screws 206. However, other types of push mechanisms that exert a pushing force to push against the removable bend cap 202 to seal with the tubing can be used. For example, other push mechanisms include hinged clamps, hydraulic pistons, pneumatic pistons, devices with threaded screws, or combinations thereof.

In particular, continuing with FIG. 2, the outer end of the jacket 201 includes a flange 221 that is positioned exterior to the furnace. A bracket 213 having its own flange 222 is connected to the jacket's flange 221, such as by bolts 204 and nuts 205. The bracket 203, also called a jacking bracket, holds a number of jack screws 206 which push against an exterior bracing surface 208 of the removable bend cap 202. A seating surface 210 of the removable bend cap 202 is pushed against the end surface 223 of the tubing. The seating surface 210 and the end surface 223 of the tubing form a seal so that little or no fluid leaks from between these surfaces. The force of the jack screws 206 help to create a stronger seal. In particular, the jack screws 206 are turned to control the amount of force pushing against the exterior bracing surface 208 of the removable bend cap 202. In an example embodiment, a gasket or some other sealing material is positioned at or between the seating surface 210 and the end surface 223 to help improve the sealing properties. In another example embodiment, a gasket is not used.

It will be appreciated that the jacket 201, the bracket 203, and the blind flange 207 are shown in a cross-sectional view, with the bracket 203 nested within the jacket 201.

The interior of the removable bend cap 202 includes a rounded surface 209 that defines an interior bend space 211. Therefore, the straight passages 110 are in fluidic communication with the interior bend space 211, allowing the fluid to flow around the bend between different straight portions of tubing.

In the example of FIG. 2, the removable bend cap only includes the surface (e.g. rounded surface 209) that defines the outer bend radius of a bend in a tube. The surface (e.g. inner bend portion 109) that defines the inner bend radius is on the fixed section of the tubing. In this way, it is easier to access and, therefore, inspect and clean, the inner surfaces of the tubing at a bend.

The system also includes a blind flange 207 that is braced against the flange 222 of the jacking bracket 214. In particular, the bolts 204 hold together the blind flange 207, the jacking bracket 203 and the jacket 201. Although bolts and nuts are shown, it will be appreciated that other clamping mechanisms or mechanical fasteners could be used.

The blind flange 207 includes an exterior surface 206 and an opposite interior surface 215. The interior surface 215 of the blind flange 207 faces the exterior surface 214 of the jacking bracket 203, and these surfaces together define a space 218 there-between.

Opposite to the exterior surface 214 of the jacket bracket 203 is the interior surface 213 of the jacking bracket 203. The bracing surface 208 of the removable bend cap faces the interior surface 213 of the jacking bracket 203, and these surfaces, together with the interior surface 229 of the jacket 201 define another space 217.

In an example embodiment, one of, or both of, the spaces 217 and 218 are filled with a thermal insulator material (insulation), such as a thermal insulator fiber, gas, liquid, vapor, or plasma. In an example embodiment, the thermal insulator is air.

In another example embodiment, one of, or both of, the spaces 217 and 218 are filled with argon gas.

In another example embodiment, one of, or both of, the spaces 217 and 218 are filled with the same fluid that is within the furnace enclosure, but is exterior to the tubing.

In another example embodiment, the thermal insulator is at a higher pressure in spaces 217 or 218, or both, compared to the pressure within the tubing. In this way, if there is leakage between the tubing and the removable bend cap, the insulator leaks into the tubing. For example, the insulator is a desirable product of a cracking process, such as ethylene, propylene, butadiene or some other hydrocarbon. If the insulator is an inert gas, and it leaks into the tubing, it will not react with the compounds therein.

To remove the removable bend cap, the blind flange 207 is first removed. The jacking bracket 203 is then removed, which provides access to the removable bend cap 202. After the jacking bracket is removed, the removable bend cap 202 is removed. The removable bend cap can then be inspected or cleaned, or both. Similarly, the tubing portions 106, 107, 109 can also be inspected or cleaned, or both.

In this way, personnel can access the bend portion of the tubing from outside of the furnace (e.g. at the exterior space 105), as well as to remove the removable bend cap 202 for inspection and cleaning while being outside the furnace. This is very convenient as it saves time. In particular, personnel do not need to wait for the furnace to cool down to enter the interior of the furnace.

Furthermore, it is easier to simply remove and replace a bend cap 202 that is worn, damaged, or has deposit build up. In other words, a new bend cap can be used to quickly replace an older bend cap.

Furthermore, personnel can use tools to mechanically unclamp the removable bend cap from the fixed portion of the tubing. In other words, personnel do not need to repeatedly cut or weld components using the system described herein.

Furthermore, it is easier for personnel to inspect a section of tubing that is fixed within the furnace, and that is close to the opening after the removable bend cap is removed. For example, personnel can more easily maneuver an inspection camera on a wire into a particular section of tubing without going through an entire length of tubing and trying to navigate many more bends.

Figure 3:
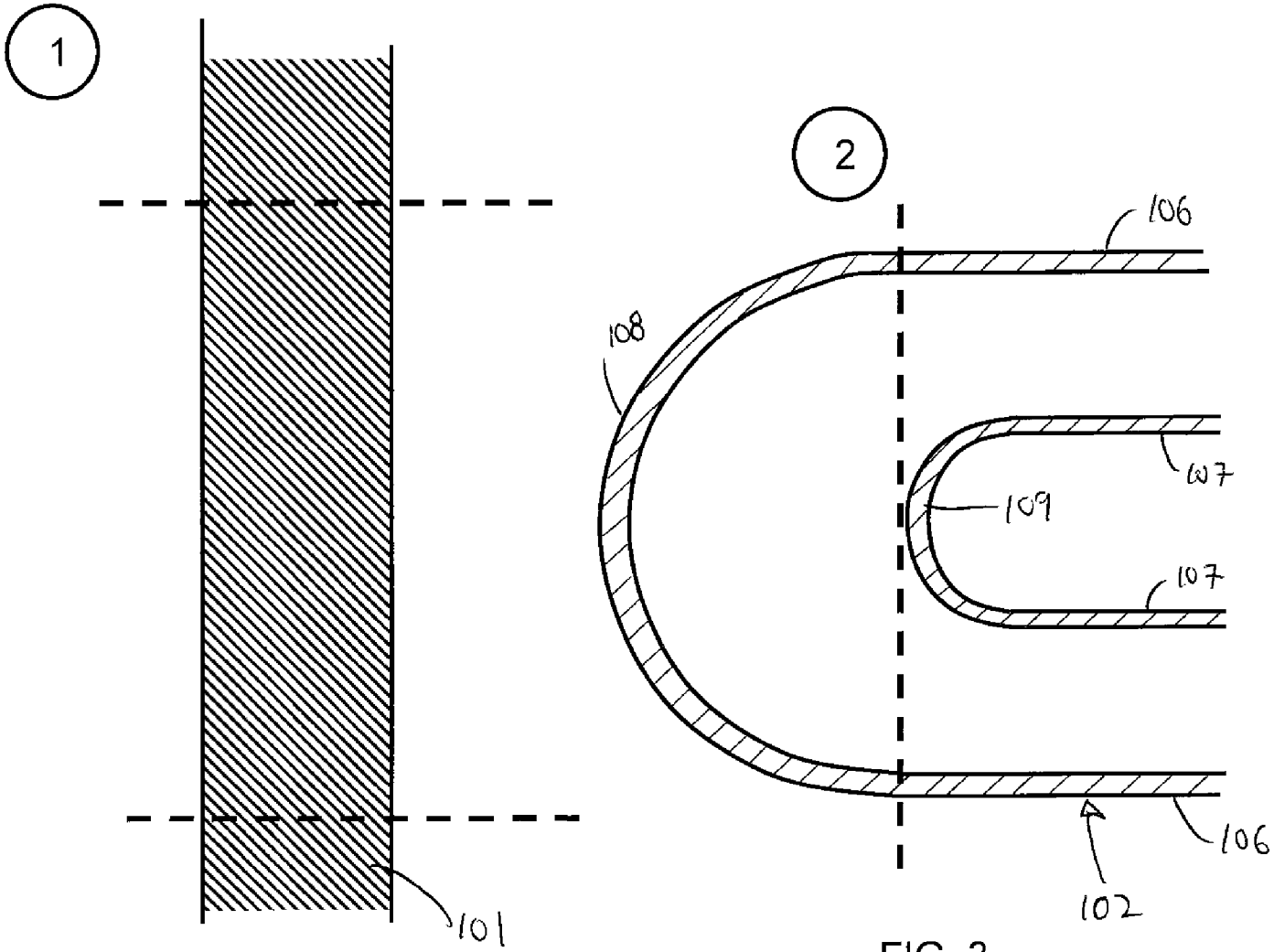
FIG. 3 is a cross-sectional view of a bend portion of the tube, according to FIG. 1, but further showing cut lines for installing the removable bend portion and the securing apparatus.

Turning to FIG. 3, example cut lines 1 and 2 are shown as part of the process for retrofitting an existing furnace with the jacket, the removable bend cap, the jacking bracket and the blind flange, as shown in FIG. 2. In particular, a passage 1 is cut through the furnace wall 101. In this way, the jacket 201 can extend through the furnace wall. The end of the tubing bend portion is cut along the line 2. In an example embodiment, the remaining portion of the tubing includes the portions 106, 107 and 109.

Figure 4:
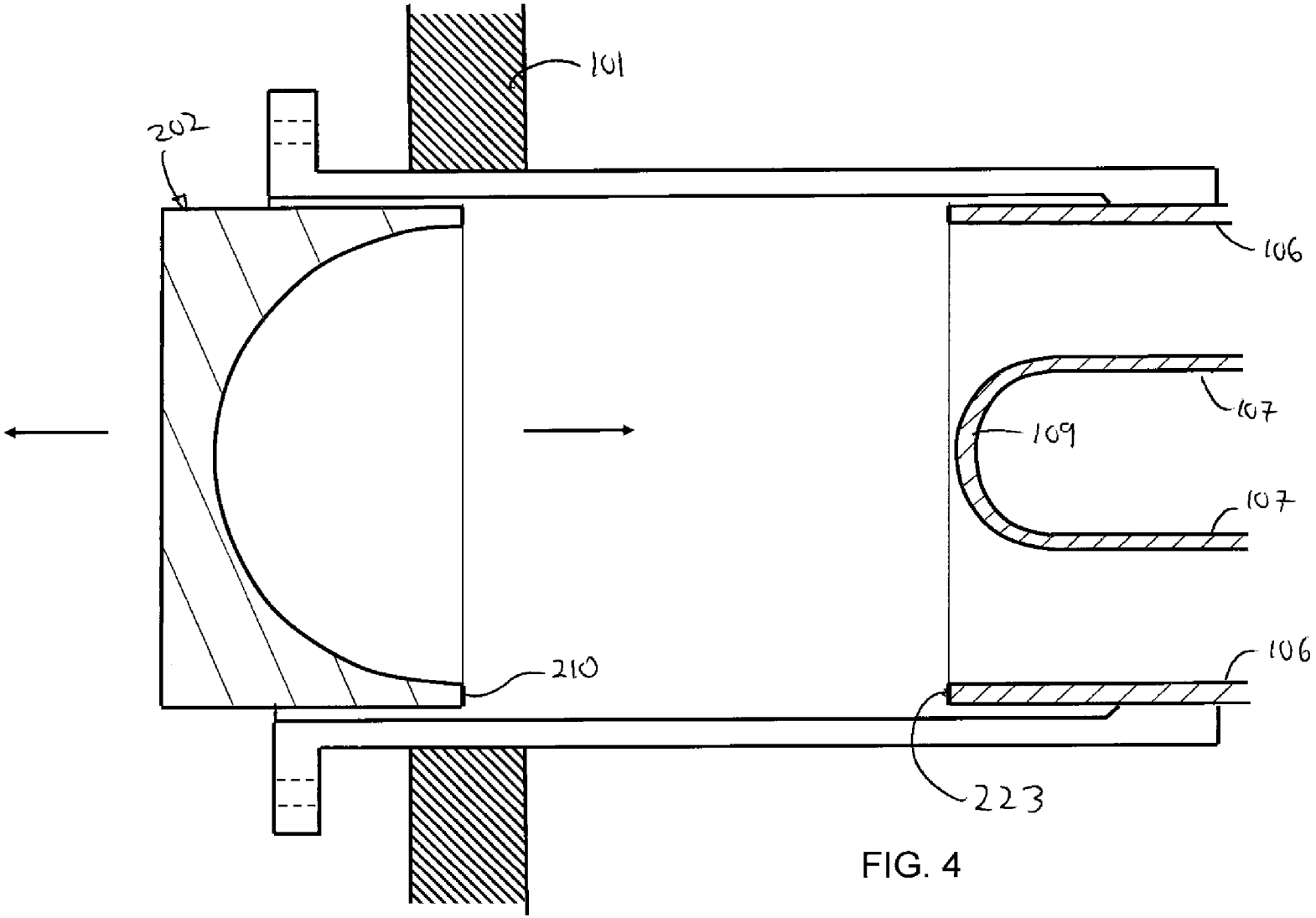
FIG. 4 is a cross-sectional view of a fixed portion of the tubing with the removable bend portion that is movable within a jacket of the securing apparatus.

As shown in FIG. 4, the jacket 201 is welded to the tubing 106 and the removable bend cap 202 is positioned within the jacket 201 and pressed against the tubing. The seating surface 210 is pressed against the end surface 223 of the tubing and is held in place, for example, by the jack screws 206. It will be appreciated that jacket 201 is shown in a cross-sectional view in FIG. 4 so as to show the bend cap 202 and the tubing there within, which are also shown in a cross-sectional view.

In another example embodiment, the jacket 201 is welded to the surface of the wall defining the opening through which the jacket extends. In this way, the jacket is anchored to a structure other than the tubing. This prevents damage that could occur, for example, during the tightening of the removable bend cap onto the tubing.

Figure 5:
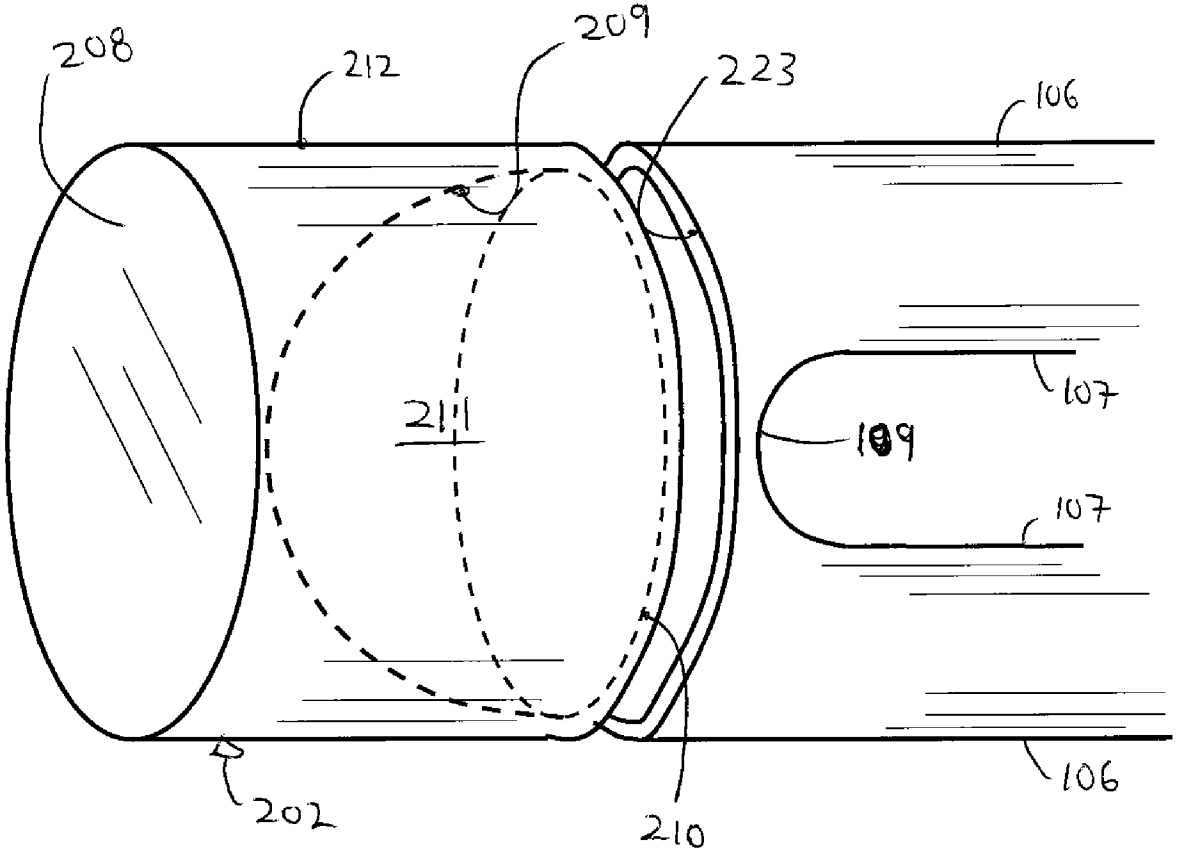
FIG. 5 is a perspective view of the fixed portion of the tubing with the removable bend portion, shown in isolation, according to an example embodiment.

FIG. 5 shows an example embodiment of the removable bend cap 202 in spaced relation to the fixed tubing section, comprising tubing portions 106, 107 and 109. As can be better seen in this embodiment, the bend cap 202 can be oblong in shape and have a rounded surface 209 that defines a bend space 211. The bend space is like an ovoid. The jacket 201 and the furnace wall 101, as well as other components, are purposely not shown in this figure, in order to better show an example of the removable bend cap and the tubing portions.

Figure 6B:
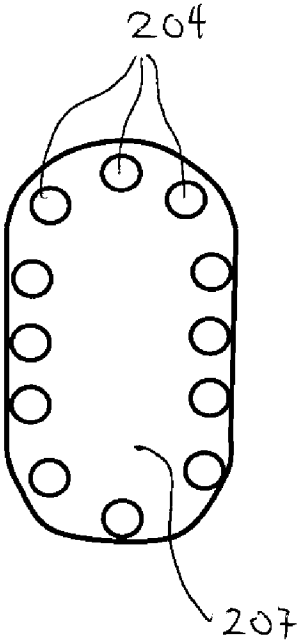
FIG. 6B is a front view of the securing apparatus as visible from the exterior of the enclosure, as per the example embodiment of FIG. 6A.

Turning to FIGS. 6A and 6B, another example embodiment of the system with the removable bend cap is shown. It includes the jacket 201 welded to the tube portions 106, 107, 109. The jacket 201 passes through a passage defined in the furnace wall, which includes an outer wall 604 and an interior insulating wall 603. The furnace wall is shown in a cross-sectional view. Other furnace wall constructions are applicable to the principles described herein.

The flange 221 of the jacket 201 sits against the flange 222 of the jacking bracket 203, and the blind flange 207 sits against the flange 222. These components are secured to each other by bolts 204.

As can be seen from the front perspective of the blind flange 207 in FIG. 6B, the flanges are oval in shape.

Although not shown, in an example embodiment, a gasket sits between the blind flange 207 and the flange 222, and another gasket sits between the flange 222 and the flange 221.

As shown in FIG. 6A, the end of the jacket 201 that is fixed to the tubing has a rounded cut-out edge 602 that is positioned to accommodate the inner bend radius surface 109. Or, in other words, according to an example embodiment, at least a portion of end of the jacket is positioned between the inner bend radius surface 109 and the end surface 223 of the tubing.

In a further example embodiment, the jacket 201 is sealed or fixed to, or both, the tubing portion 600. The tubing portion 600 is then welded to another tubing portion 601 along the weld lines 605.

For example, in another example of retrofitting a furnace, the initial tubes are cut at the weld lines 605, which produces a remaining tubing portion 601. Then, the tube portion 600, which includes the opening defined by the end surface 223 and the jacket 201 welded to the tube portion 600, is welded to the remaining tubing portion 601. The jacket 201 is placed through a passage or opening in the furnace wall; the removable bend cap 202 is inserted into the jacket; and the removable bend cap 202 is clamped or pushed against the end surface 223 of the tubing.

Figure 7:
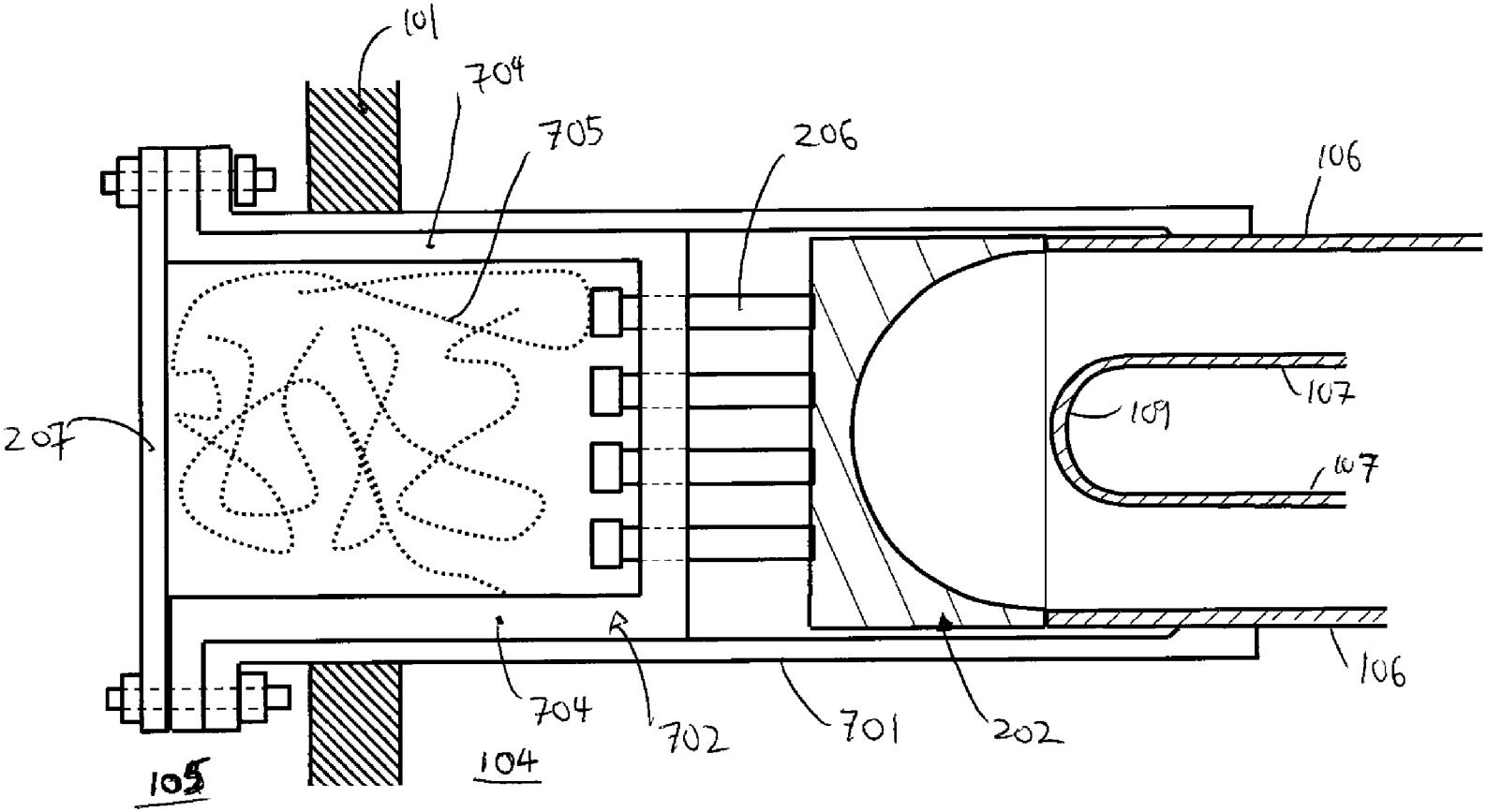
FIG. 7 is a cross-section view of a removable bend portion of a tube with a securing apparatus, with the removable bend portion of the tube placed at a further distance from the enclosure wall, according to another example embodiment.

Turning to FIG. 7, another example embodiment is shown which similar to the example shown in FIG. 2. However, the tubing portions 106, 107, 109 and the removable bend cap 202 are positioned at a greater distance away from the furnace wall 101. In such a case, the jacket 701 is longer so as to extend from the exterior space 104 of the furnace to the tubing portions.

The jacking bracket 702 includes a plate 703 to hold jack screws 206. A side wall 704 surrounds the plate 703, and the length of the side wall 704 is selected so that the plate 703 is sufficiently close to the removable bend cap 202, so that the jack screws 206 can push against the bend cap 202. The space or void defined between the blind flange 207 and the jacking bracket 702 is filled with a heat resistant insulation. In an example embodiment, the insulation is inert.

In another example embodiment, the material flowing through the tubing is ethylene and the insulation is an inert gas. In this way, if there is a leak between the insulation and the ethylene in the tubing, then the insulation does not react with the ethylene, which is the desired product.

Figure 8:
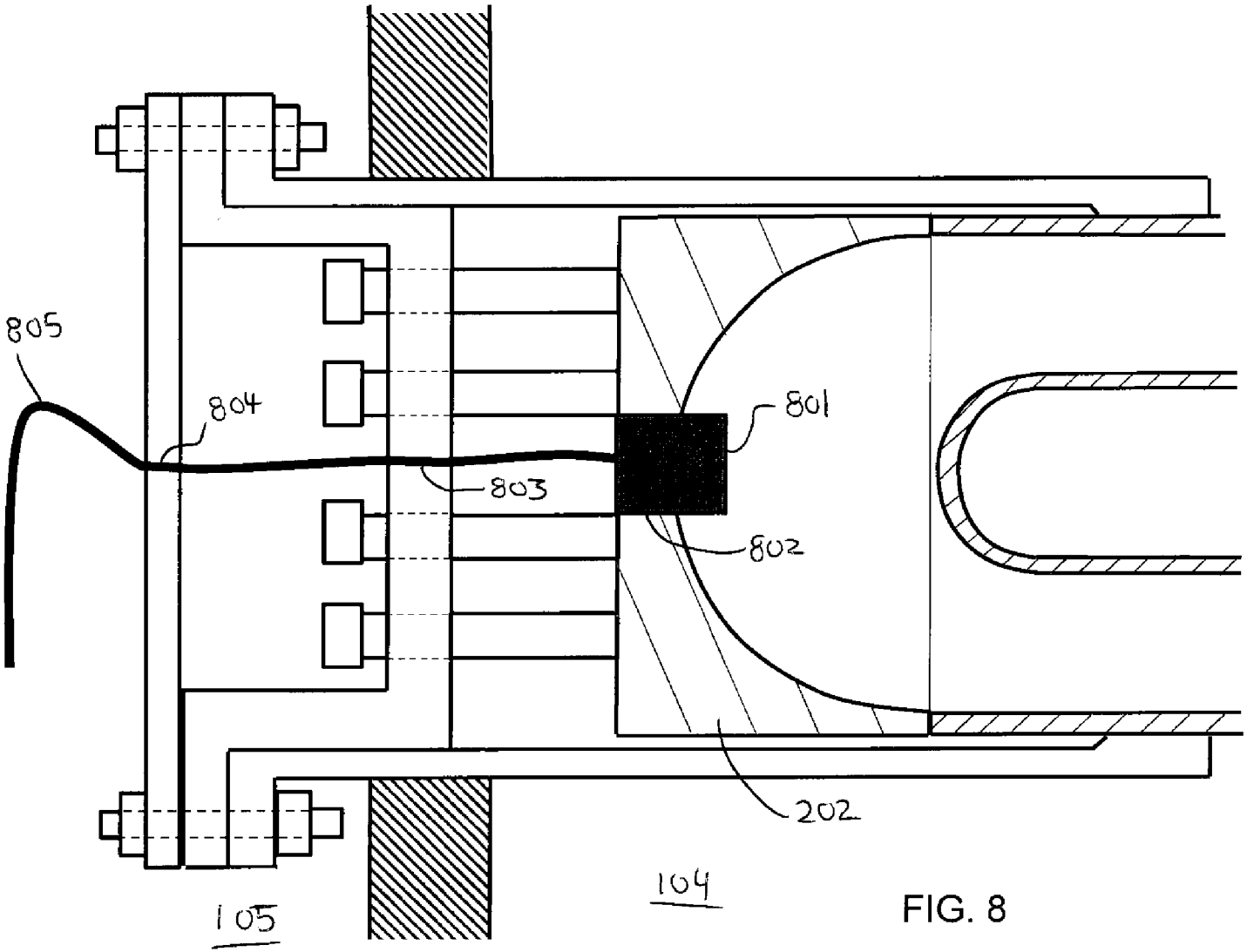
FIG. 8 is a cross-sectional view of a removable bend portion of a tube, with the removable bend portion including an electronic device, according to another example embodiment.
Figure 9:
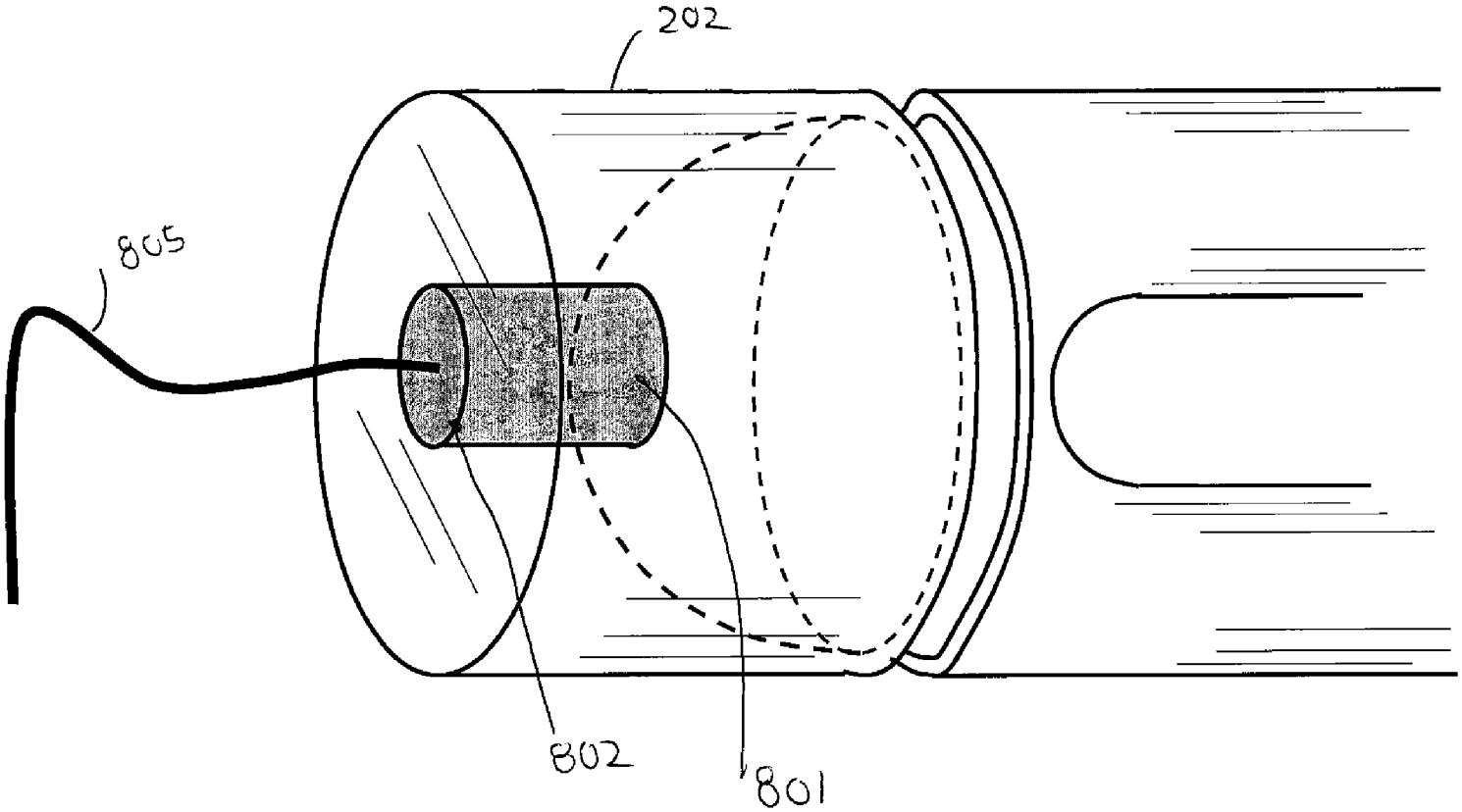
FIG. 9 is a perspective view of the removable bend portion of the tube with the embedded electronic device shown in the example embodiment of FIG. 8.

Turning to FIGS. 8 and 9, another example embodiment of a removable bend cap 202 is shown, which includes an aperture 802 that holds an electronic device 801. In an example embodiment, a portion of the electronic device 801 is in direct contact with the removable bend cap and another portion is in contact with the fluid that fills the tubing.

In one example embodiment, the electronic device 801 is an electrically powered cleaning device. For example, a liquid fills the tubing and the liquid and the cleaning device are in contact with each other. The cleaning device then emits energy, which is transmitted through the liquid, to clean the inner surfaces of the tubing.

In an example embodiment, the cleaning device includes one or more ultrasonic transducers.

In another example embodiment, the cleaning device includes at least one of a sonic transducer and an ultrasonic transducer.

The ultrasonic transducers are powered and operated at frequency settings to cause cavitation of the liquid within the tube.

In an example embodiment, the sonic transducers include sound emitters for audible sound in the approximate frequency range 20-20,000 Hz. In another example, the sonic transducers are devices, e.g. pulsators, that emit non-audible sound, infrasound, in the approximate frequency range 2-20 Hz. In an example embodiment, the sonic transducers emit acoustic energy at frequencies in the range extending from 60 to 800 Hz.

In another example embodiment the cleaning device is a mechanical device or an electromechanical device that produces vibrations. This type of device is also known as a vibrator. For example, an electric motor or an electric actuator, or a combination of both, are used to generate vibrations. The vibrations are used to loosen and dislodge the build-up of material on the inner surface of a tubing. The vibrations are, for example, emitted to vibrate the tube wall itself, or the liquid within the tube, or both.

It another example embodiment, the cleaning device includes a combination of a vibrator and an acoustic transducer (e.g. a sonic transducer or an ultrasonic transducer).

In addition or in an alternative example embodiment, the cleaning device includes a heating element to assist with the cleaning process.

In addition or in an alternative example embodiment, the cleaning device includes a light source to emit light for the purposes of cleaning. For example, the light source shines ultraviolet (UV) light to aid in the cleaning process.

In another example embodiment, the electronic device 801 is a sensor. For example, the electronic device 801 senses one or more of pressure, flow, temperature, chemical properties, viscosity, or other aspects of the fluid in the tubing. Other types of data or properties could be sensed by one or more sensors. In an example embodiment, the electronic device 801 also includes an indicator device to display the sensed value or values.

In another example embodiment, either in alternative or in combination with the indicator device, the electronic device 801 includes a communicator to communicate the sensed value or values. For example, the communicator could be wires that transmit the sensed value or values. In another example, the communicator is a wireless communication device that uses radio signals (e.g. WiFi, BlueTooth, cell data networks, low frequency radio waves, etc.) to transmit the sensed value or values. In yet another example embodiment, the communicator is a wireless communication device that uses light signals (e.g. infrared light, laser light, etc.) to transmit the sensed value or values. A corresponding receiving device receives the sensed value or values from the communicator. Then the receiving device displays the sensed value or values on a display device or retransmits this data, or both.

As the electronic device 801 is embedded in the removable bend cap 202, it can be conveniently removed for servicing or replacement. In another example, a removable bend cap 202 that includes an electronic device 801 can be temporarily installed at a bend of tubing and then later removed and replaced with a different removable bend cap that does not include an electronic device. In other words, removable bend caps including various types of electronic devices, or not including any at all, can be swapped in and out as desired.

Figure 10:
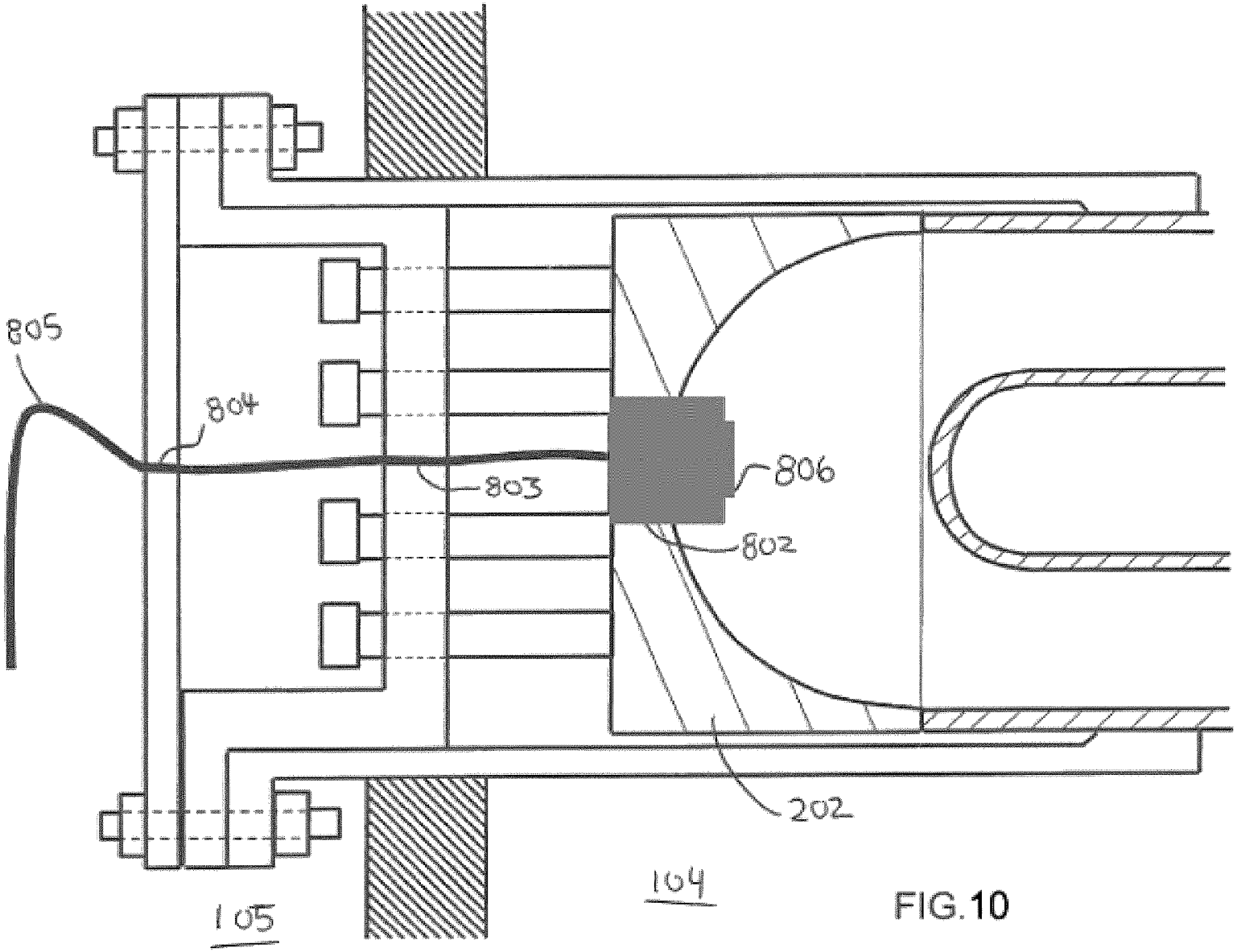
FIG. 10 is a cross-sectional view of a removable bend portion of a tube, with the removable bend portion including a micro-wave emitter, according to another example embodiment.

Turning to FIG. 10, another aspect of a removable bend cap 202 is shown, which includes an aperture 802 that holds a micro-wave emitter 806. In an example embodiment, a portion of the micro-wave emitter 806 is in direct contact with the removable bend cap 202 and another portion is in contact with the fluid that fills the tubing.

In another example embodiment, a micro-wave emitter 806 emits radiation to heat the fluid flowing through the tubing in a steam cracking process. It is believed that heating the material flowing through the tubing using the micro-wave emitter 806 can reduce the heat energy contribution from heat generators and/or furnaces guns necessary to facilitate thermal cracking, thereby reducing fossil fuel consumption of the heat generators and/or furnace guns. It is also believed that heating the material flowing through the tubing using the micro-wave emitter 806 can also increase the energy efficiency of the process.

In yet another example embodiment, returning to FIG. 3, a passage is cut in the wall of a steam cracking furnace in an oil refinery or petrochemical plant along example cut line 1. The jacket is then able to extend through the wall, and the end of the tubing bend portion connecting two parallel sections of tubing is cut along example cut line 2. The removable bend cap having a microwave emitter embedded therein, as shown in FIG. 10, is then attached to the end surface of the tubing along cut line 2 to connect the parallel sections of tubing. As discussed above, the micro-wave emitter 806 emits radiation to heat the fluid flowing through the tubing. In this example embodiment, the fluid is ethane feed diluted with steam. Without being held to any theory, it is believed that the presence of steam aids the microwave heat transfer mechanism, thereby further increasing the energy efficiency of this process.

It will be appreciated that the use of the retrofitting techniques discussed herein may provide a cost effective way to test and/or implement microwave-assisted hydrocracking in existing refineries without having to re-design the reactors.

In yet another example embodiment, the fluid in the tubing is heated by micro-wave radiation generated by the micro-wave emitter 806 and by convective and/or radiative heat transfer from heat generators or furnace guns in the furnace.

In yet another example embodiment, a micro-wave emitter 806 heats the fluid flowing through the tubing in a furnace without any heat energy contribution from furnace guns, heat generators or other heat sources.

It will be appreciated that the term "micro-wave emitter" used herein refers to any type of micro-wave emitter.

It will also be appreciated that the term "jacket" is used interchangeably with the term "sleeve" herein. Therefore, it will be appreciated that these terms refer to the same feature.

It will be appreciated that tubing within industrial process equipment may comprise more than one bend portion connecting two sections of tube, each of which may be replaced by a removable bend portion. Therefore, the tubing may comprise more than one removable bend portion/cap, each of which may comprise at least one micro-wave emitter or at least one cleaning device.

It will also be appreciated that one or more micro-wave emitters can be embedded at any location within tubing, in any configuration, either during manufacturing or retrofitting of a furnace or any other type of industrial process equipment comprising tubing to heat a fluid flowing through the tubing.

Continuing with FIGS. 8-10, a passage 803 is defined in the jacking plate and a passage 804 is defined in the blind flange to allow a wire 805 to pass through, to connect to the electronic device 801 in FIGS. 8 and 9, or the micro-wave emitter 806 in FIG. 10. In one aspect, the wire supplies electrical power to the cleaning device. In another aspect, the wire supplies electrical power to the micro-wave emitter 806.

In another aspect, an electronic device such as that discussed above may be provided in combination with the micro-wave emitter 806.

In another example embodiment, the electronic device 801 is battery powered, so that the wire 805 is not required.

Figure 11:
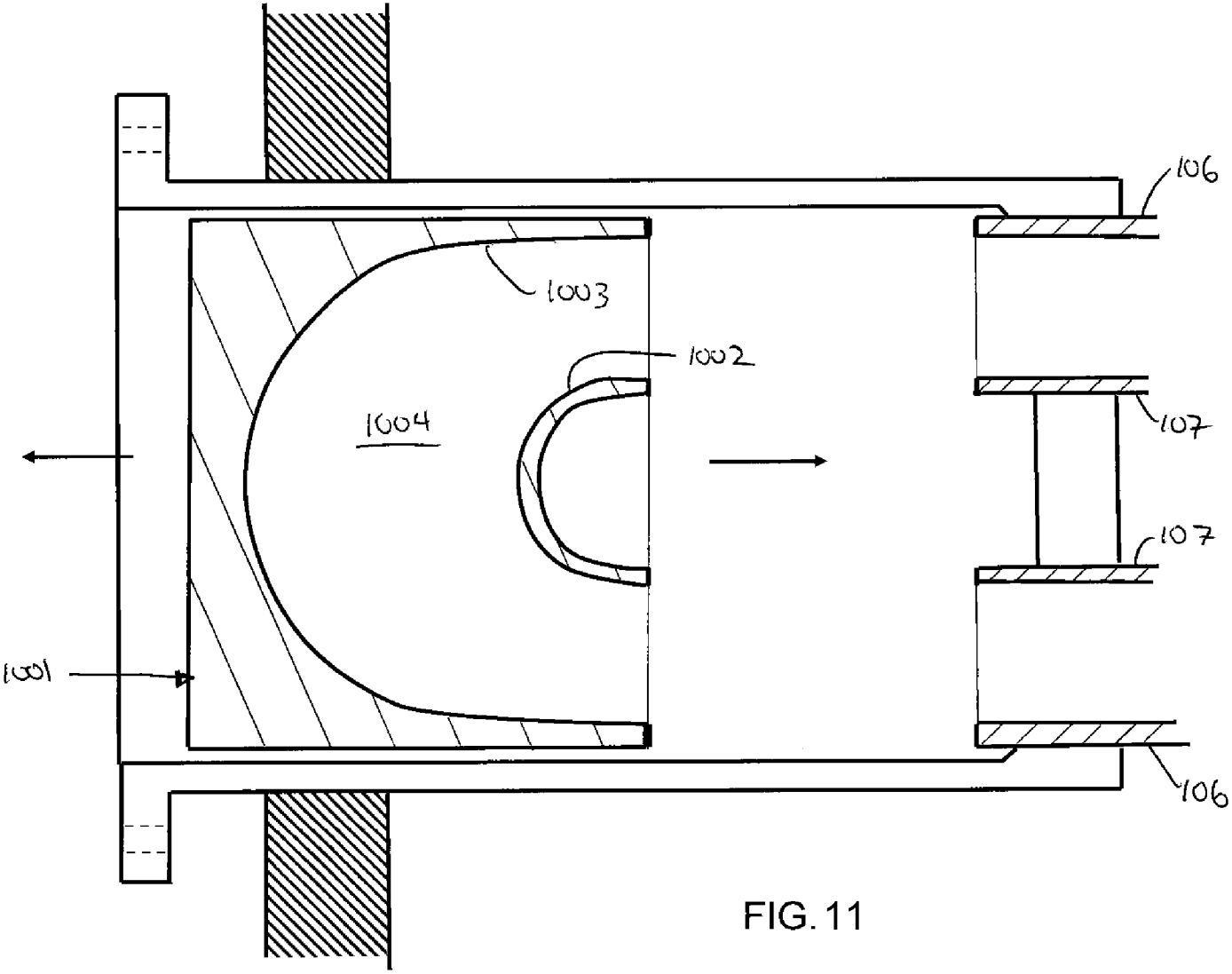
FIG. 11 is a cross-sectional view of another example embodiment of a fixed portion of the tubing with a removable bend portion that is movable within a jacket of the securing apparatus. The removable bend portion is dimensioned to include the entire bend, including the inner and the outer bend surfaces.

Turning to FIG. 11, another example embodiment is shown, in which the removable bend cap 1001 includes an inner radius bend wall 1002 and an outer radius bend wall 1003, which together define a bend space 1004.

Figure 12:
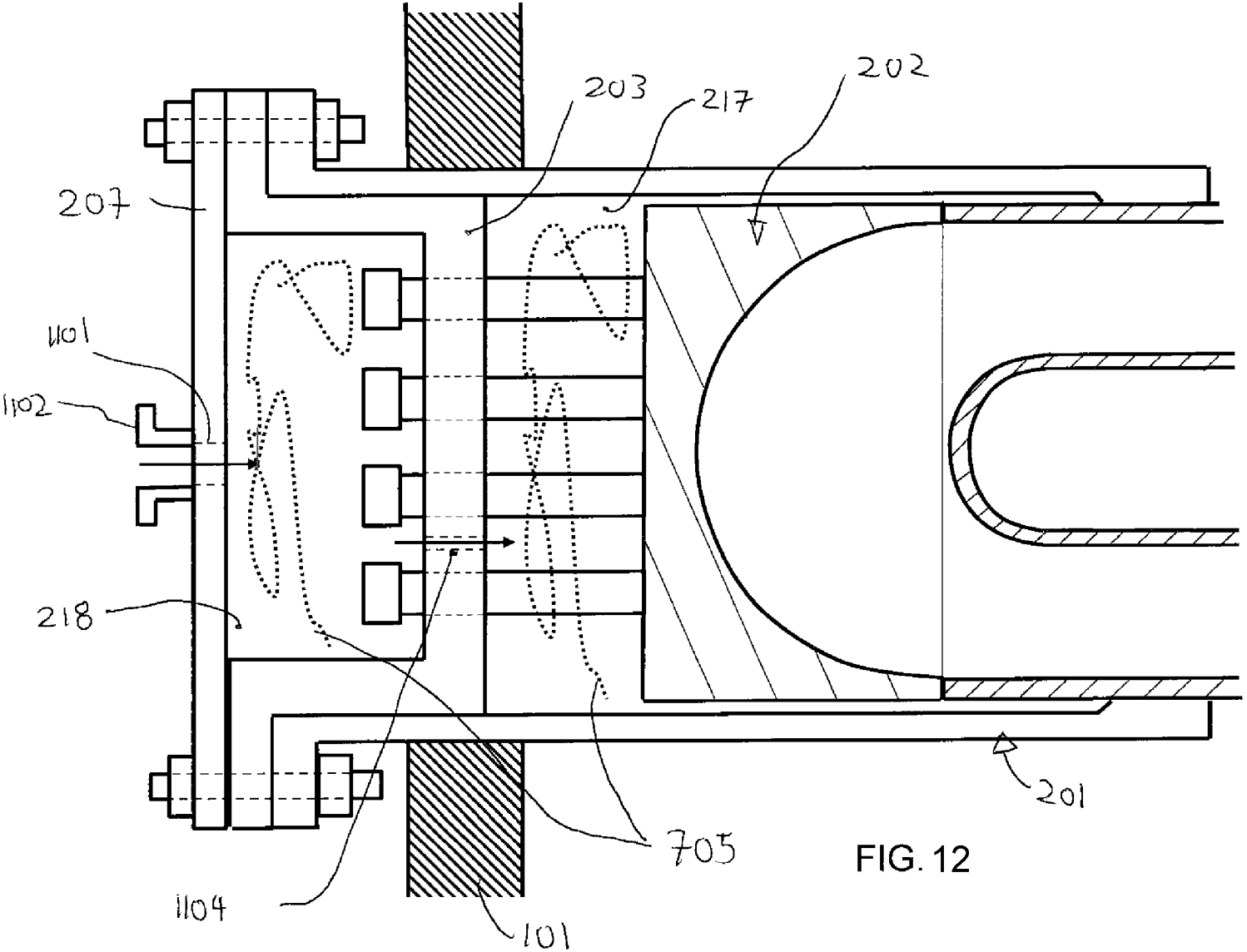
FIG. 12 is a cross-sectional view of a removable bend portion of a tube with a securing apparatus, and further including a sealable opening to insert insulation into the securing apparatus, according to another example embodiment.

Turning to FIG. 12, another example embodiment is shown similar to the example embodiment shown in FIG. 2. However, in FIG. 12, the blind flange 207 includes an aperture or opening 1101 with a corresponding flange 1102 mounted on the exterior surface of the flange 207. The opening 1101 is used to pump in insulation 705. For example, a hose can be attached to the flange 1102, and the insulation 705 then flows through the hose and through the opening 1101, into the space 218. After a desired amount of insulation has been pumped into the apparatus, then the hose is removed and the flange 1102 is sealed.

In another example, there is an opening 1104 in the bracket 203. Insulation 705 flows from the space 218 through the opening 1104, and into the space 217.

In an example embodiment, the insulation 705 is a gas, liquid, vapor, plasma, or a combination thereof, and it is at a higher pressure compared to the pressure in the tubing.

In another example embodiment, the space 217 is at a higher pressure than the fluid flowing through the tubing to exert a pressure-gradient force against the removable bend cap, thereby retaining it firmly against the tubing and preventing leaks.

It will be appreciated that the aforementioned space can be pressurized in the presence or absence of insulation. The insulation can also include commonly used furnace lining insulation if the fluid in the tubing is at extreme temperatures. Examples of materials commonly used in furnace insulation include but are not limited to polycrystalline wool, refractory ceramic fiber, and low bio-persistent fiber.

It will be appreciated that a U-bend is shown in the figures. However, the principles apply to other types of bends that may be at different angles to each other (e.g. L-bends, V-bends, etc.).

It will be appreciated that the term "industrial process equipment" used herein refers to any equipment required when using physical or chemical methods for mechanical and/or thermal treatment or processing of a raw material or product. It will therefore be appreciated that the term "industrial process equipment" does not exclude small-scale, or laboratory scale equipment.

It will be appreciated that the term "apparatus for heating a fluid" used herein refers to any equipment having tubing that is used to heat a fluid. Examples of such equipment include but are not limited to heat exchangers and cracking furnaces.

It will be appreciated that the terms "apparatus having tubing within an enclosure" or "an apparatus having one or more tubes within an enclosure" used herein refer to equipment having tubing for conveying a fluid through the equipment or through an enclosure in the equipment.

It will be appreciated that different features of the example embodiments of the system, the method and the apparatus, as described herein, may be combined with each other in different ways. In other words, different modules, operations and components may be used together according to other example embodiments, although not specifically stated.

The steps or operations in the flow diagrams described herein are just for example. There may be many variations to these steps or operations without departing from the spirit of the invention or inventions. For instance, the steps may be performed in a differing order, or steps may be added, deleted, or modified.

Although the above has been described with reference to certain specific embodiments, various modifications thereof will be apparent to those skilled in the art without departing from the scope of the claims appended hereto.

The invention claimed is:

1. An apparatus for heating a fluid, the apparatus comprising:

a chamber;

one or more tubes for conveying the fluid through the chamber, at least one of the tubes having a bend; and the bend comprising a removable bend cap, the removable bend cap including at least one microwave emitter.

2. The apparatus of claim 1 wherein the at least one bend has a generally U-shaped structure.

3. The apparatus of claim 1 wherein the apparatus is a furnace.

4. The apparatus of claim 1 further comprising a sleeve, the sleeve comprising:

a first end extending into the chamber through an opening in a wall of the chamber, the first end of the sleeve being adapted to contain the removable bend cap;

a second end extending through the opening to an exterior of the chamber, the second end of the sleeve comprising a first flange; and a jacking bracket comprising a second flange, the second flange being removably attached to the first flange.

5. The apparatus of claim 4 wherein the first end of the sleeve is attached to one of the tubes comprising the removable bend cap.

6. The apparatus of claim 4 wherein the jacking bracket comprises a push mechanism that exerts a pushing force against the removable bend cap to retain the bend cap against the at least one tube.

7. The apparatus of claim 6 further comprising jack screws extending from the jacking bracket to exert the pushing force against the removable bend cap to retain the bend cap against the at least one tube.

8. The apparatus of claim 6 wherein the pushing force is exerted against an exterior bracing surface of the removable bend cap to retain the bend cap to the at least one tube.

9. The apparatus of claim 4 wherein the second end of the sleeve further comprises a blind flange connected over the second flange, and wherein the blind flange, the second flange, and the first flange are fastened together.

10. The apparatus of claim 9 further comprising a first space defined between the blind flange and the jacking bracket and a second space defined between the jacking bracket, an interior surface of the sleeve and the removable bend cap.

11. The apparatus of claim 10 wherein the fluid within the at least one tube is at a first pressure, the second space is at a second pressure, and the second pressure is higher than the first pressure to exert a pressure-gradient force against the removable bend cap to retain the bend cap to the at least one tube.

12. The apparatus of claim 4 wherein the sleeve is welded to a surface defining the opening in the wall through which the sleeve extends, and wherein the first end is welded to one of the tubes comprising the removable bend cap.

13. An apparatus for removably attaching a bend in one or more tubes in an enclosure, the one or more tubes being adapted to convey a fluid through the enclosure, the bend comprising a removable bend cap, the apparatus comprising:

a sleeve comprising a first end attached to at least one of the tubes comprising the bend cap and extending into the enclosure through an opening in a wall of the enclosure, the sleeve further comprising a second end extending through the opening to an exterior of the enclosure, the second end of the sleeve comprising a first flange and a jacking bracket adapted to exert a force against the bend cap to retain the bend cap against the at least one tube, the jacking bracket comprising a second flange, the second flange being removably attached to the first flange.

14. The apparatus of claim 13 wherein the pushing force is exerted against an exterior bracing surface of the removable bend cap to retain the bend cap against the at least one tube.

15. The apparatus of claim 13 wherein the second end of the sleeve comprises a blind flange connected over the second flange, and wherein the blind flange, the second flange, and the first flange are fastened together.

16. An apparatus having one or more tubes within an enclosure, the apparatus comprising:

the one or more tubes being for conveying a fluid through the enclosure, at least one of the tubes having a bend;

the bend comprising a removable bend cap, the removable bend cap including at least one cleaning device; and a sleeve, the sleeve comprising:

a first end extending into the enclosure through an opening in a wall of the enclosure, the first end of the sleeve being attached to at least one of the tubes comprising the bend cap and being adapted to contain the removable bend cap;

a second end extending through the opening to an exterior of the enclosure, the second end of the sleeve comprising a first flange; and a jacking bracket comprising a second flange, removably attached to the first flange, and being adapted to exert a force against the bend cap to retain the bend cap against the at least one tube.

17. The apparatus of claim 16 wherein the cleaning device comprises at least one ultrasonic or sonic transducer.

18. The apparatus of claim 16 wherein the force exerted against the bend cap is exerted against an exterior bracing surface of the bend cap to retain the bend cap against the at least one tube.

19. The apparatus of claim 16 wherein the second end of the sleeve further comprises a blind flange connected over the second flange, and wherein the blind flange, the second flange, and the first flange are fastened together.

* * * * *